US007209696B2

(12) United States Patent
Umezawa et al.

(10) Patent No.: US 7,209,696 B2
(45) Date of Patent: Apr. 24, 2007

(54) IMAGE HEATING APPARATUS WITH ELASTIC CONDUCTIVE MEMBER CONTACTING INTERNAL SURFACE OF ROTATION MEMBER

(75) Inventors: Masao Umezawa, Mishima (JP); Atsutoshi Ando, Yokohama (JP); Hiroshi Shiba, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 199 days.

(21) Appl. No.: 10/995,228

(22) Filed: Nov. 24, 2004

(65) Prior Publication Data

US 2005/0163540 A1 Jul. 28, 2005

(30) Foreign Application Priority Data

Nov. 28, 2003 (JP) ..... 2003-400082

(51) Int. Cl.
*G03G 15/20* (2006.01)

(52) U.S. Cl. ..... 399/329; 219/216

(58) Field of Classification Search ..... 399/33, 399/37, 67, 328, 329, 320; 361/214; 219/216
See application file for complete search history.

(56) References Cited

U.S. PATENT DOCUMENTS

| | | | | |
|---|---|---|---|---|
| 5,132,744 | A * | 7/1992 | Maruta et al. | 399/329 |
| 5,157,446 | A * | 10/1992 | Kusaka | 399/329 |
| 5,525,775 | A | 6/1996 | Setoriyama et al. | 219/216 |
| 6,014,539 | A * | 1/2000 | Sano et al. | 399/329 |
| 6,347,201 | B1 | 2/2002 | Sano et al. | 399/67 |
| 6,430,386 | B2 | 8/2002 | Okubo et al. | 399/328 |
| 6,438,349 | B2 | 8/2002 | Ando | 399/333 |
| 6,748,192 | B2 * | 6/2004 | Izawa et al. | 399/329 |
| 6,915,099 | B2 * | 7/2005 | Izawa et al. | 399/328 |
| 6,920,293 | B2 * | 7/2005 | Izawa et al. | 399/67 |
| 6,944,420 | B2 * | 9/2005 | Kanamori et al. | 399/329 |
| 2003/0035667 | A1 | 2/2003 | Izawa et al. | 399/333 |
| 2004/0033084 | A1 | 2/2004 | Akizuki et al. | 399/69 |
| 2004/0081491 | A1 | 4/2004 | Uchida et al. | 399/328 |
| 2004/0105693 | A1 | 6/2004 | Akizuki et al. | 399/69 |
| 2004/0197112 | A1 | 10/2004 | Saito et al. | 399/69 |

FOREIGN PATENT DOCUMENTS

| | | | |
|---|---|---|---|
| JP | 4-44075 | | 2/1992 |
| JP | 09319242 | A * | 12/1997 |
| JP | 10-10893 | | 1/1998 |
| JP | 11-15303 | | 1/1999 |
| JP | 2000259015 | A * | 9/2000 |
| JP | 2000259037 | A * | 9/2000 |
| JP | 2003-045615 | | 2/2003 |
| JP | 2003-156954 | | 5/2003 |
| SU | 568105 | A * | 8/1977 |

* cited by examiner

*Primary Examiner*—Robert Beatty
(74) *Attorney, Agent, or Firm*—Fitzpatrick, Cella, Harper & Scinto

(57) ABSTRACT

An image heating apparatus includes a rotation made of a metal, a heater to which a current is applied, whereby heat dissipates from the heater and the heater contacts an internal surface of the rotation member, and a pressure roller for pressurizing the rotation member together with the heater to form a nip, wherein the rotation member is electrically grounded via a fuse. By the virtue of the invention, it is rendered possible to suppress charging of the metal rotation member and to suppress a current leak to a main frame of an image forming apparatus.

3 Claims, 6 Drawing Sheets

IMAGE HEATING APPARATUS WITH ELASTIC CONDUCTIVE MEMBER CONTACTING INTERNAL SURFACE OF ROTATION MEMBER

BACKGROUND OF THE INVENTION

1. Field of the Invention

The present invention relates to an image heating apparatus, adapted for use as a toner image fixing apparatus in an image forming apparatus such as a copying apparatus, a laser beam printer, a facsimile or the like.

More specifically, the present invention relates to an image heating apparatus adapted for use as a fixing apparatus in a process of forming an unfixed toner image corresponding to desired image information on a recording medium (paper, printing paper, transfer sheet, a transparent sheet for an overhead projector (hereinafter referred to as an OHT sheet), glossy paper, glossy film etc.) either by a direct method or an indirect (transfer) method, utilizing a toner constituted for example of heat fusible resin and employing image forming process such as electrophotography, electrostatic recording or magnetic recording, and heat fixing such unfixed toner image as a permanent fixed image on the recording medium bearing such image.

2. Related Background Art

In an image forming apparatus such as a printer or a copying apparatus, image formation is often executed by an electrophotographic process, and, in such process, a toner image is formed on a recording medium by a transfer method or a direct method, and is fixed by applying heat and pressure to such recording medium.

A fixing apparatus for fixing the toner image has conventionally employed a heat roller system. This system is basically constituted of a metal roller provided therein with a heater, and an elastic pressure roller pressed thereto, and a recording medium which is a member to be heated is introduced into a nip portion of the paired rollers, and pinched and passed therein to heat the toner image under heat and pressure.

However the fixing apparatus of such heat roller type requires a very long time for elevating the roller surface to a fixing temperature, because of a large heat capacity of the roller. For this reason, in order to achieve a prompt image outputting operation, the roller surface has to be controlled at a certain temperature even while the apparatus is not in use.

Therefore, Japanese Patent Application Laid-open No. H4-44075 teaches an image heating apparatus of a film heating type. Such image heating apparatus is generally constituted of a thin heat-resistant film, a heater fixed at the side of a surface of the film, and a pressure roller provided at the other surface and opposed to the heater for contacting the recording medium to be heated to the heater through the film. When such apparatus is employed as a fixing apparatus, a recording medium on which a toner image is formed is introduced into and passed by a nip portion formed by the heater and the pressure roller, with the film interposed, whereby the surface bearing a visualized image on the recording medium is heated by the heater through the film to give the unfixed image with thermal energy and the image is heat fixed by softening and fusing of the toner.

The image heating apparatus of the aforementioned film heating type, capable of employing a heater of a low heat capacity as the heating member, can achieve an electric power saving and a shorter wait time in comparison with the prior apparatus of a heat roller type or a belt heating type.

However, the image heating apparatus of film heating type, utilizing a polyimide film or the like having a very small heat capacity, has a limitation in the fixing property or the glossiness for use in an image forming apparatus requiring a high process speed or a color image fixation.

It is therefore strongly desired to enable a high speed drive or an adaptation to a color image forming apparatus, while retaining advantages of inexpensiveness and absence of warm-up operation in the image heating apparatus of film heating type. A heat conductivity of the film is important in achieving a higher speed. In order to transmit the heat of the heater promptly to the recording medium, the film has to be constituted of a material of a thermal conductivity as high as possible. Also in order to adapt to a color image formation, the film has to be provided with an elastic layer. In a film provided with an elastic layer, when a toner image passes through the fixing nip, the elastic layer is deformed according to the toner layer whereby the toner is enclosed by the elastic layer and is uniformly heated to achieve a uniform fixation. Such uniformly fixed image is free from unevenness in luster and shows an excellent transmission of the image particularly in case of a fixation of an OHT sheet.

For enabling a higher speed or a color image formation as explained above, Japanese Patent Application Laid-open Nos. 2003-45615 and 2003-156954 propose an image heating apparatus of film heating type employing a metal of higher thermal conductivity such as stainless steel or nickel instead of usual resinous material for a base material of the film.

However, in case of employing a metal film, it is charged for example by a frictional charging by a conveyed material to be heated, thereby leading, in case of a fixing apparatus, to an uneven gloss or an image defect because of phenomena that the unfixed toner is scattered from the recording medium to be heated or is attracted to the film surface. Also the accumulated charge, if released at once at a certain timing, causes a noise to a signal system and may induces an erroneous operation in the main body of the apparatus.

Also in case a heating member, in sliding contact with the metal film, is broken by any reason, an electric current may leak from such broken heating member to a main frame of the image forming apparatus through the metal film, thereby eventually resulting in a danger of electric shock.

SUMMARY OF THE INVENTION

The present invention has been made in consideration of the aforementioned drawbacks and is to provide an image heating apparatus capable of suppressing a charging of a metal rotary member and also suppressing a current leak to a main frame of an image forming apparatus.

Another object of the invention is to provide an image heating apparatus including a rotation member made of a metal, a heater to which current is applied, whereby heat dissipates from the heater, the heater contacts an inside of the rotation member, and a pressure roller for forming a nip portion in cooperation with the heater, with the rotation member being interposed, wherein the rotation member is electrically grounded via a fuse.

Still other objects of the invention will become fully apparent from the following detailed description which is to be taken in conjunction with the accompanying drawings.

Figure 1:
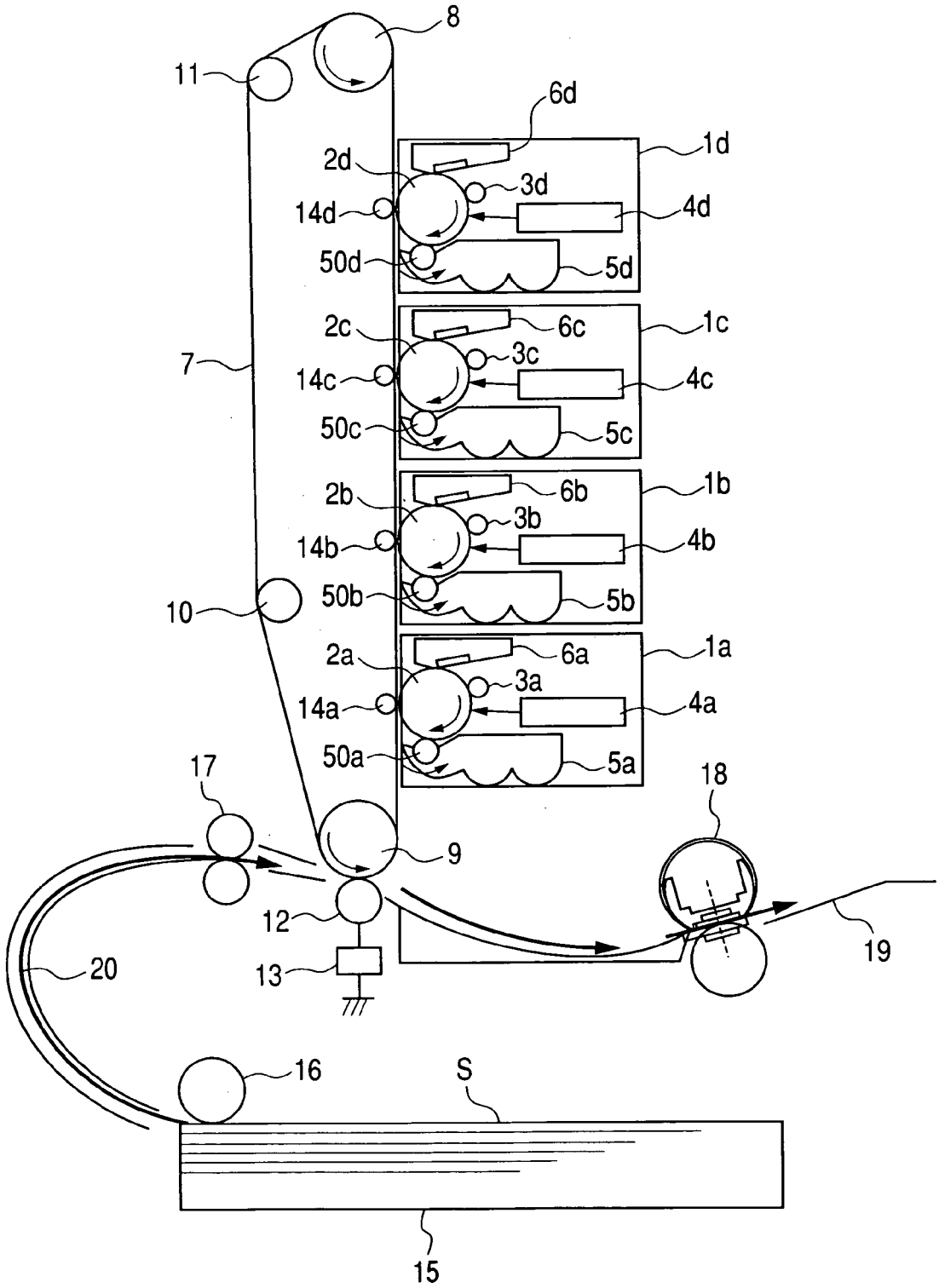
FIG. 1 is a schematic view showing a configuration of an image forming apparatus constituting an embodiment.

DESCRIPTION OF THE PREFERRED EMBODIMENTS (First Embodiment)

(1) Example of Image Forming Apparatus

An image forming apparatus of the present embodiment is a full-color image forming apparatus utilizing an electrophotographic process, and is provided with four process stations 1*a* to 1*d*, arranged substantially linearly in a substantially vertical direction and adapted to form images of respectively different colors (magenta, cyan, yellow and black), and a conveying path 20 for conveying a sheet S as a recording medium.

The process stations 1*a* to 1*d* are equipped at least with photosensitive drums 2*a* to 2*d* for bearing latent images, and, around the photosensitive drums 2*a* to 2*d*, there are provided charging rollers 3*a* to 3*d* for uniformly charging the photosensitive drums 2*a* to 2*d*, exposure devices 4*a* to 4*d* for irradiating the photosensitive drums 2*a* to 2*d* with laser beams for forming latent images, developing means 5*a* to 5*d* for developing the latent images formed on the photosensitive drums 2*a* to 2*d* with toners of respective colors (magenta, cyan, yellow and black) thereby forming visible images, and cleaning apparatuses 6*a* to 6*d* for removing residual toners on the photosensitive drums 2*a* to 2*d*.

The developing means 5*a* to 5*d* are provided with developing sleeves 50*a* to 50*d* for carrying toners. The developing sleeves 50*a* to 50*d* are supported with a predetermined gap to the corresponding photosensitive drums 2*a* to 2*d*, and, at a developing operation, a developing bias is applied between the photosensitive drums 2*a* to 2*d* and the developing sleeves 50*a* to 50*d*.

An intermediate transfer belt 7 is supported by a drive roller 8, an idler roller 9 and belt supporting rollers 10, 11, and is rotated in a direction indicated by an arrow in the drawing.

The intermediate transfer belt 7 is conveyed along a direction of array of the process stations 1*a* to 1*d*, and the toner images of respective colors on the photosensitive drums 2*a* to 2*d* are transferred, in the respective stations and in succession, by primary transfer means 14*a* to 14*d* onto the intermediate transfer belt thereby forming a full-color image.

On the other hand, sheets S are stacked in a sheet cassette 15 provided in a lower part of the apparatus, and are separated and fed one by one by a sheet feed roller 16 from the sheet cassette 15 and supplied to paired registration rollers 17. The paired registration rollers 17 advances a fed sheet into a gap between the intermediate transfer belt 17 and a secondary transfer roller 12.

A surface in a lowermost part of the intermediate transfer belt 17 contacts a secondary transfer roller 12 so positioned as to be opposed to the idler roller 9, and the secondary transfer roller 12 pinches and conveys the passing sheet S in cooperation with the intermediate transfer belt 7. The secondary transfer roller 12 is given a bias from a high voltage source 13 (bias means), whereby the sheet S, passing between the secondary transfer roller 12 and the intermediate transfer belt, receives a secondary transfer of the toner image borne on the intermediate transfer belt, and is conveyed toward a fixing apparatus 18.

The sheet S, bearing the transferred toner image, is supplied to the fixing apparatus 18, and is heated and pressurized therein, whereby the toner image is fixed to the sheet S. In this manner an image is formed on the sheet S, which is then discharged from the fixing apparatus 18 to a discharge tray 19 outside the apparatus.

(2) Fixing Apparatus 18

Figure 2:
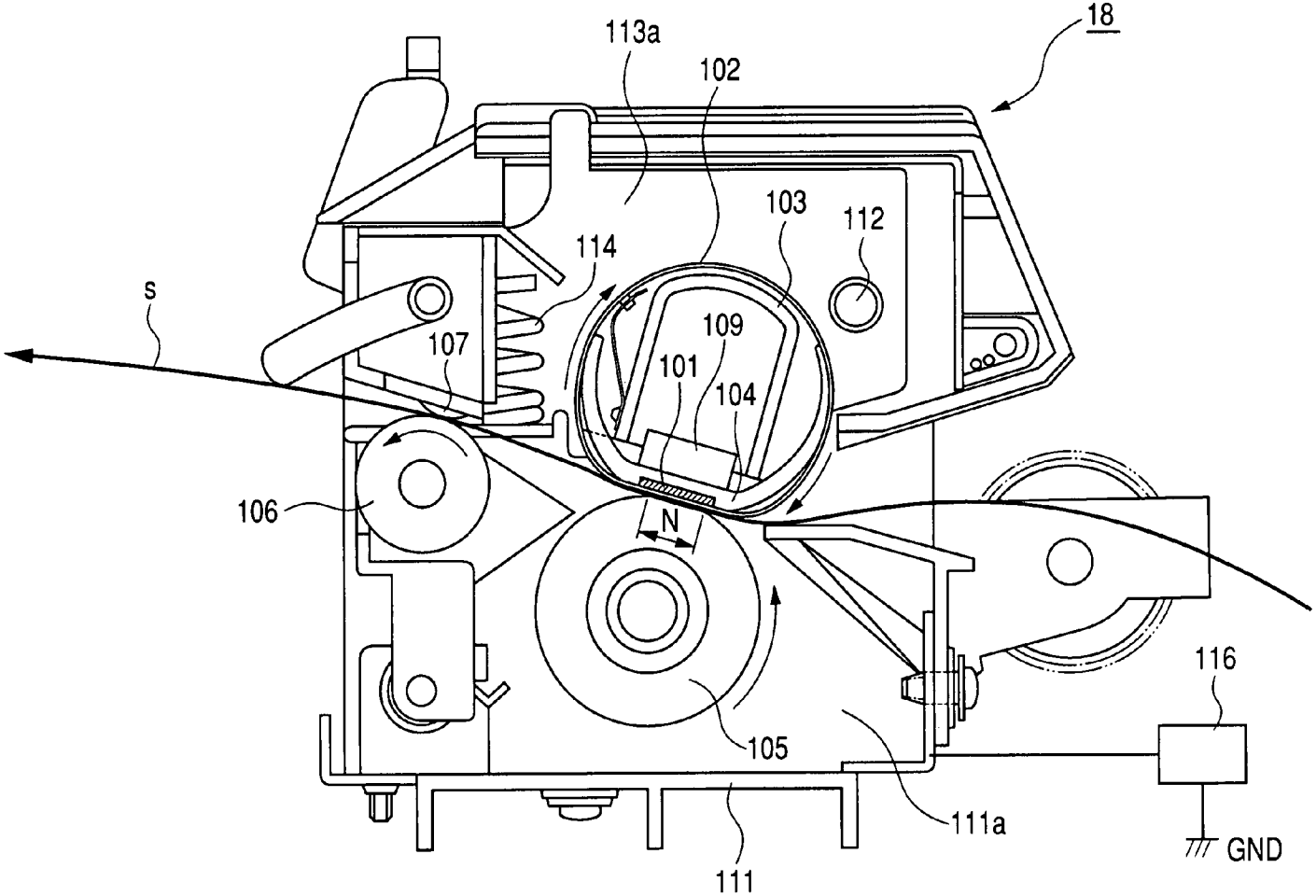
FIG. 2 is a lateral cross-sectional view of a fixing apparatus.
Figure 3:
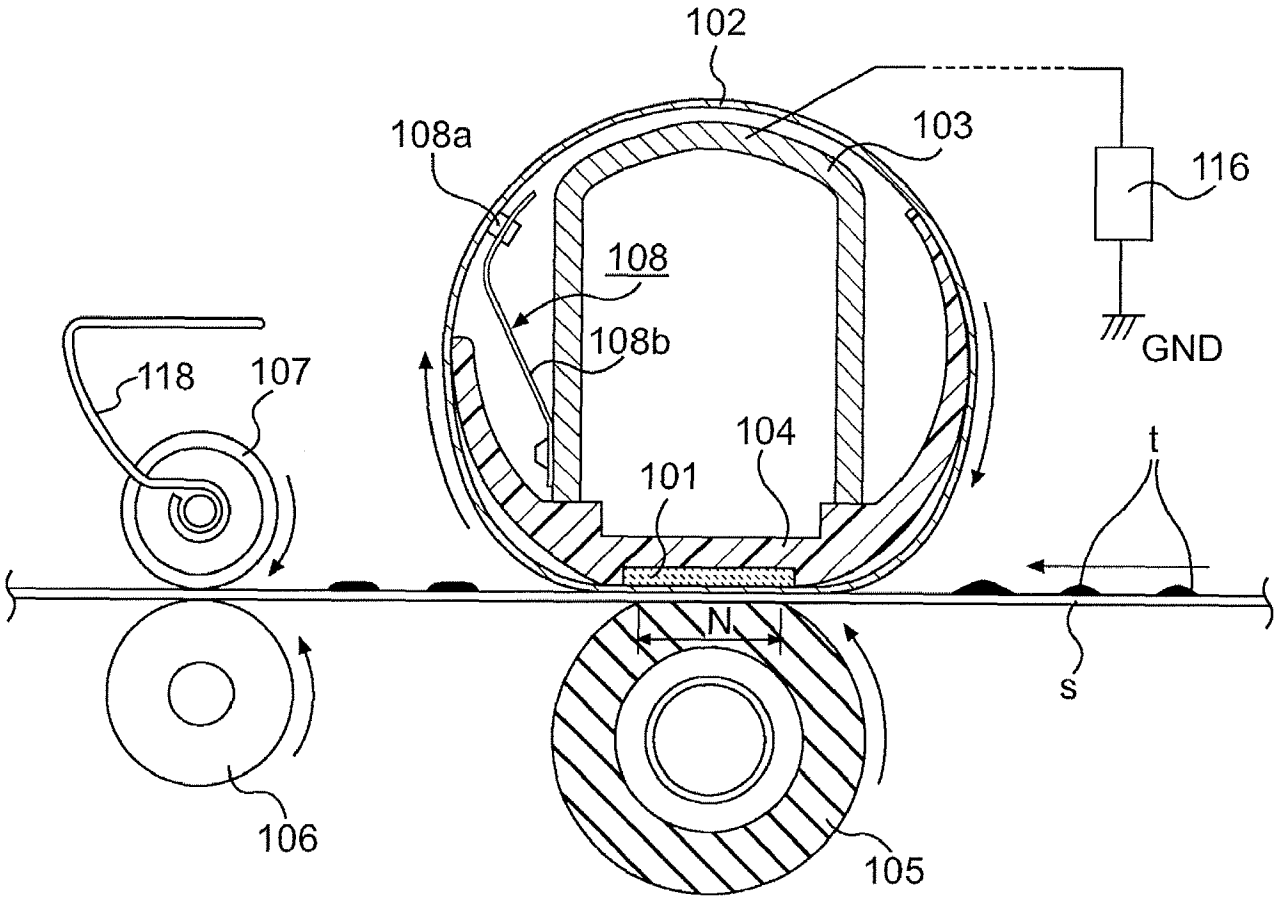
FIG. 3 is a partial magnified view of FIG. 2.
Figure 4:
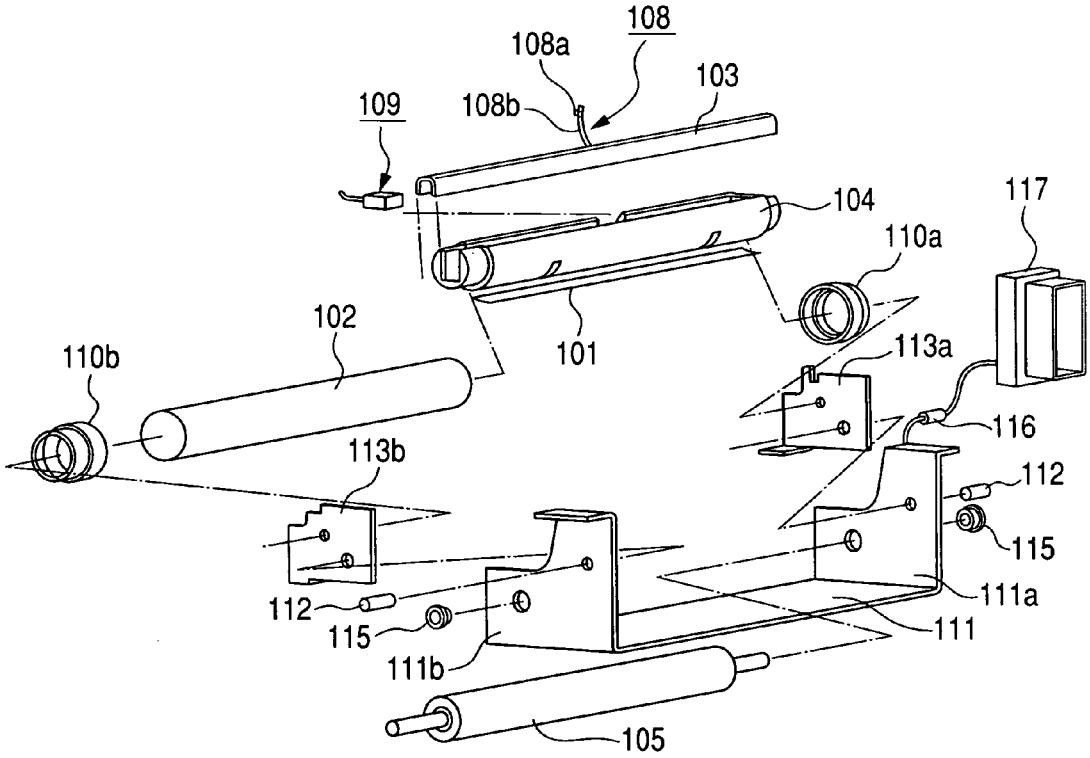
FIG. 4 is an exploded perspective view of principal components constituting the fixing apparatus.

FIG. 2 is a lateral cross-sectional view of the fixing apparatus 18, FIG. 3 is a partial magnified view of FIG. 2, and FIG. 4 is an exploded perspective view of principal components of the fixing apparatus.

The fixing apparatus 18 of the present embodiment is of a film heating type, employing a cylindrical metal film (metal rotary member) as a film and driven by a pressure roller.

There are provided a ceramic heater 101 as a heating member, a cylindrical metal film 102, a rigid pressurizing metal stay member 103 having an inverted U-shaped cross section, a heat resistance and rigid heater holder 104 of a trough shape having a substantially semicircular cross section, and a pressure roller (pressurizing rotary member) 105 serving as a pressurizing member.

The pressure roller 105 is an elastic roller constituted for example, on a stainless steel metal core, of a silicone rubber layer of a thickness of about 3 mm formed by injection molding and providing thereon a PFA resin tube of a thickness of about 40 μm. The pressure roller 105 is rotatably supported, at both ends of the metal core, by bearings on lateral plates 111*a*, 111*b* at the rear and front sides of a main frame 111 of the apparatus, made of a metal plate.

The heater holder 104 is molded for example with a heat resistant liquid crystal polymer, and the heater 101 is fitted on a lower face of the holder 104 and along the longitudinal direction thereof. The cylindrical metal film 102 is loosely fitted on the heater holder 104 with the heater 101. The stay 103 is inserted in the heater holder 104. The metal stay 103 is fixed, at both ends in the longitudinal direction thereof, to swing lateral plates 113*a*, 113*b* made of metal plates to be explained later.

Figure 5:
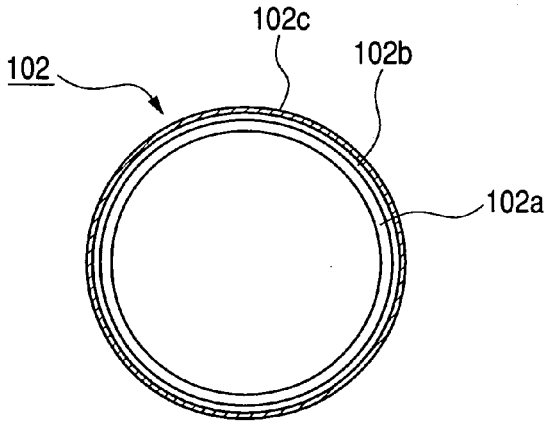
FIG. 5 is a schematic view showing a layer structure of a metal film.

The metal film 102 in the present embodiment is a composite film of a certain heat capacity, for the purpose of ensuring a fixing property for a color image, constituted of a metal layer 102*a* such as of stainless steel or nickel, an elastic layer 102*b* and a releasing layer 102*c* from the inside, as shown in a schematic view of FIG. 5 showing a layered configuration.

A heating assembly is constituted principally of the heater 101, the cylindrical metal film 102, the stay 103, and the heater holder 104. The heating assembly is supported, with the heater 101 downwards, between the swing lateral plates 113*a*, 113*b* made of metal plates.

The swing lateral plates 113*a*, 113*b* are rotatably supported, about a rotation fulcrum 112, with respect to rear and front lateral plates 111*a*, 111*b* of the main frame 111 of the apparatus. The aforementioned heating assembly is supported, by both ends of the stay 103, between the rear and front swing lateral plates 113*a*, 113*b*. On rear and front ends of the cylindrical metal film 102, flanges 110*a*, 110*b* are provided so as to be driven by the rotation of the film 102. The flanges 110*a*, 110*b* are rotatably supported by the rear and front swing lateral plates 113*a*, 113*b*.

The swing lateral plates 113*a*, 113*b* are biased in rotation respectively by pressurizing springs 114 (FIG. 2) in a direction to press down the both ends of the stay 103. Thus the heater holder 103 is pressed downwards by the stay 103, thereby pressing a downward face of the heater 101 to the pressure roller 105 across the metal film 102, at a predetermined pressure against the elasticity of the elastic layer. Such pressing forms a nip (fixing nip) of a predetermined width between the heater 101 and the pressure roller 105 across the metal film 102.

Figure 6A:
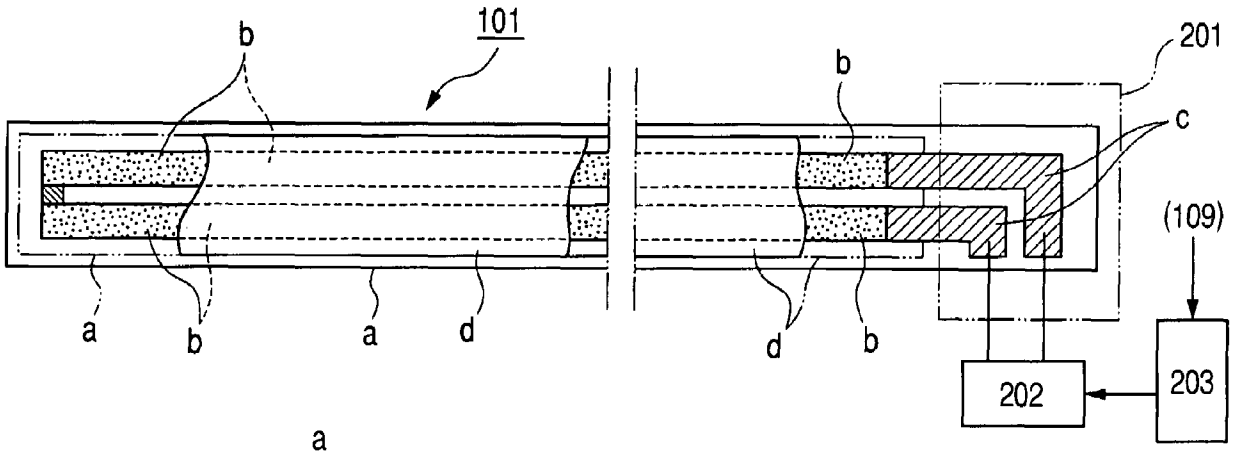
FIG. 6A is a schematic plane view of an example of a heater surface, omitting an intermediate portion.
Figure 6B:
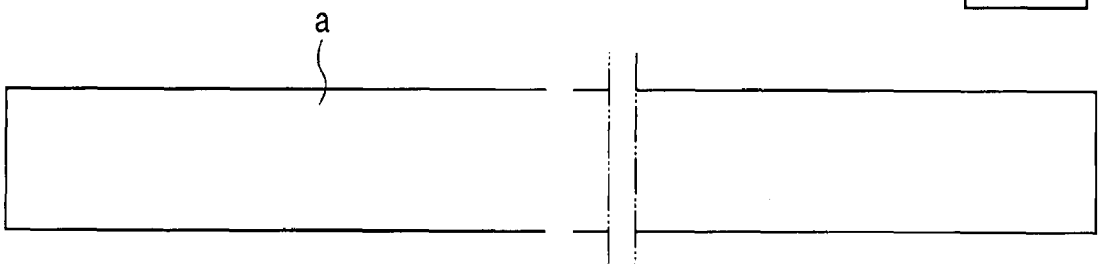
FIG. 6B is a schematic plane view of an example of a rear heater surface, omitting an intermediate portion.
Figure 6C:
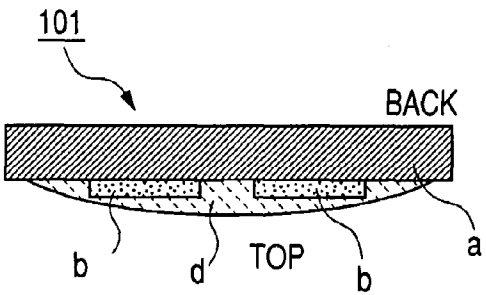
FIG. 6C is a schematic cross-sectional view of an example of the heater.

FIGS. 6A, 6B and 6C are schematic views showing an example of the heater 101. FIG. 6A is a schematic plane view of a heater surface, with an intermediate portion omitted. FIG. 6B is a schematic plane view of as rear heater surface, with an intermediate portion omitted. FIG. 6C is a schematic magnified cross-section of the heater. The heater 101 is constituted of a ceramic heater substrate a, a heat-generating resistor b printed on the substrate 1, and an electrode portion c. The heat-generating resistor b is formed in one turn from the electrode portion c, along the longitudinal direction of the heater substrate a. Also an area of the heat-generating resistor b on the substrate a is contained within the fixing nip N formed between the pressure roller 105 and the metal film 102. The heat-generating resistor b is formed in an as wide area as possible within the fixing nip N in order to increase a section where the recording medium S is heated within the fixing nip N thereby increasing the fixing property. Also a glass layer d for protecting the heat-generating resistor b is provided on the heat-generating resistor b.

The heater 101 is so fixed and supported by the heater holder 104 that a surface side (side of the glass layer d) is in contact with an internal surface of the metal film 102.

On the electrode portion c of the heater 101, a current supplying connector 201 is mounted. A current supply from a heater driving circuit 202 to the electrode portion c through the connector 201 generates heat in the heat-generating resistor b thereby rapidly elevating the temperature of the heater 101. The heater driving circuit 202 is controlled by a control circuit (CPU) 203.

In a state of normal use, the metal film 102 starts to rotate when the pressure roller 105 starts to rotate, and a temperature increase of the heater 101 elevates an internal temperature of the metal film 102. The temperature of the internal surface of the metal film 102 is detected by temperature detection means 109 to be explained later, and information of the detected temperature is entered into the control circuit 203, which controls the current supply to the heater 101 so as to control the temperature of the heater 101 at a predetermined fixing temperature.

The pressure roller 105 is rotated at a predetermined peripheral speed, by drive means (not shown). The rotation of the pressure roller 105 exerts a rotating power to the cylindrical metal film 102 by a friction between the pressure roller 105 and the metal film 102 at the nip N, whereby the film 102 is driven around the external periphery of the heater holder 104, under a sliding contact with the downward face of the heater 101. The heater holder 104 serves also as a guide member for the rotated cylindrical metal film 102. Grease is coated on the internal surface of the cylindrical metal film 102, in order to ensure sliding motion between the internal surface of the metal film 102 and the heater 101 or the heater holder 104.

In a state where the pressure roller 105 is rotated to also rotate the cylindrical metal film 102 and the heater 101 is energized, showing a rapid temperature increase and controlled at a predetermined temperature, a recording medium S bearing an unfixed toner image t is introduced between the metal film 102 and the pressure roller 105 at the nip portion N, in which the recording medium S, with a toner image bearing surface thereof in close contact with the external surface of the metal film 102, is pinched and conveyed together with the metal film 102. In the course of such conveying process, the recording medium S is heated by the heat of the metal film 102, which is heated by the heater 101, whereby the unfixed toner image t on the recording medium S is heat fixed thereto by heat and pressure. After passing the nip portion N, the recording medium S is separated by a curvature from the metal film 102. An upper discharge roller 107, pressurized by a sheet discharge spring 118 (FIG. 3) forms a nip in cooperation with a lower discharge roller 106 to discharge the recording medium S, bearing the fixed toner image, to a discharge tray 19.

Figure 7:
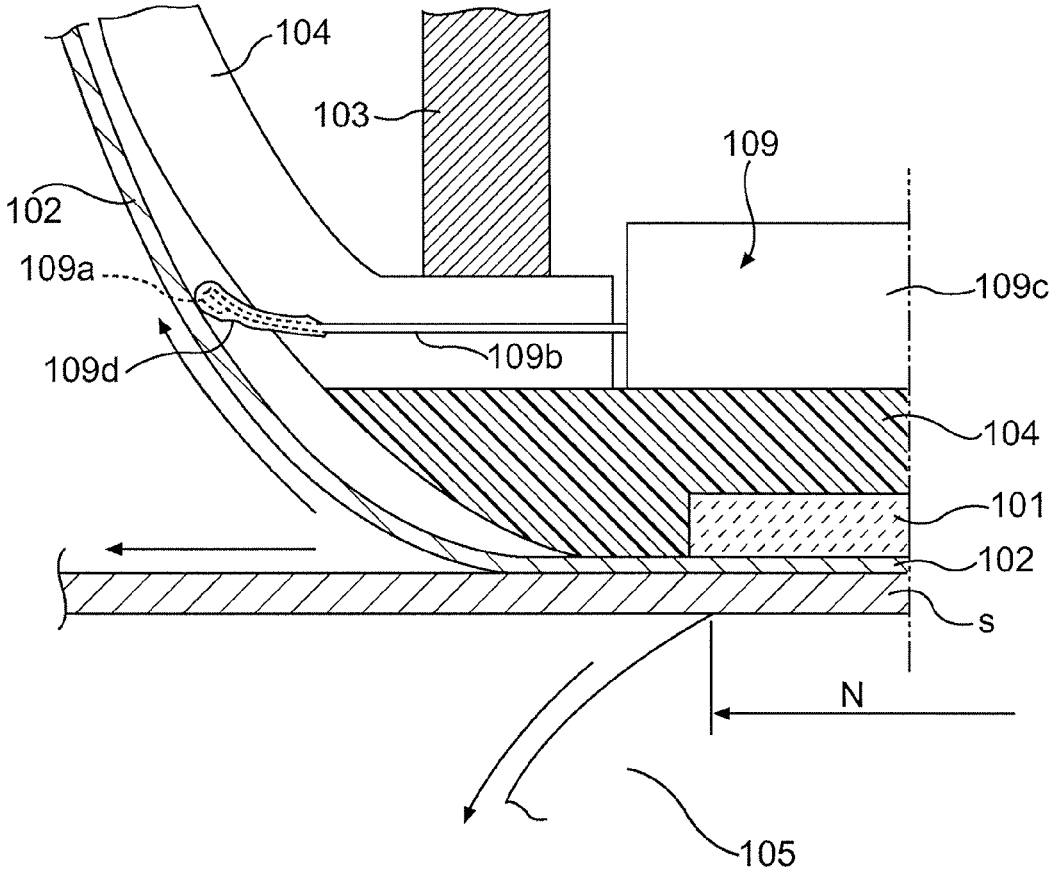
FIG. 7 is a schematic magnified view of temperature detecting means.

Temperature detection means 109 detects an internal surface temperature of the metal film 102, and FIG. 7 is a partial magnified view of the temperature detection means 109. The temperature detection means 109 is constituted of a base portion 109*c* to be fixed on the heater holder 104, a spring plate 109*b* serving as a temperature detection element supporting member having a spring elasticity and extending from the base portion 109*c* toward the internal surface of the metal film 102, a thermistor 109*a* provided at a front end of the spring plate 109*b* and serving as a temperature detection element, and an insulating coating 109*d* which is formed for example by a film of a heat resistant resin and covers the thermistor 109*a* and the spring plate 109*b* for electric insulation from the metal film 102, whereby the thermistor 109*a* is pressed in a contact state by the elasticity of the spring plate 109*b* with the internal surface of the metal film 102. An internal temperature of the metal film 102 is measured as an electrical signal by the thermistor 109*a* which is electrically insulated by the insulation coating 109*d* from the metal film 102, and such electrical temperature information is supplied, through an electrical path (not shown), to the control circuit 203 for controlling the current supply to the heater 101 so as to maintain the temperature thereof at a predetermined fixing temperature. Such configuration of measuring the temperature of the metal film 102 in a downstream position of the nip portion N, at a predetermined distance from "the heater 101 positioned at the nip N and maintained in contact with the internal surface of the metal film 102" allows to avoid an influence of direct heat from the heater 101 and to achieve an exact detection of heat amount taken away by the sheet S.

A conductive member 108 is fixed in electrically conductive state on the metal stay 103, and is contacted at a front end portion with the internal surface of the metal film 102, thereby maintaining the metal film 102 and the stay 103 in an electrical conductive state. The conductive member 108 is constituted of an elastic conductive member 108*b* such as a metal plate fixed at an end to the metal stay 103, and a contact member 108*a* such as a carbon tip fixed on the other end of the conductive member 108*b* and pressed to the internal surface of the metal film 102 by the elasticity of the conductive member 108*b*. The contact member 108*a* is in constant contact with the internal surface of the metal film 102 and slides thereon (on the internal surface of the metal layer 102*a*) while maintaining an electrically conductive state. Such configuration enables a secure conduction of the metal film 102, which has a rubber layer on the outer surface and is therefore difficult to achieve an electrical contact from the outer surface, and does not require a new wiring by utilizing the metal stay 103 as a part of the electrical path, thereby achieving a smaller dimension in the metal film 102. Therefore, the metal film 102 is rendered conductive with the aforementioned metal member 108, then the metal stay 103, the swing lateral plates 113*a*, 113*b* of metal plates supporting the same, and the main frame 111 of the apparatus supporting the same. The main frame 111 of the apparatus is further connected to a fuse 116 as an excess current preventing element, which is connected through a connector 117 to the ground of the main body.

In this manner, the metal film 102 is grounded through the above-described path. The grounding of the metal film 102 avoids charging thereof. It is thus possible to avoid phenomena of scattering the unfixed toner t on the recording medium S by the charging of the metal film 102 or attracting the toner on the film surface, thereby preventing gloss unevenness or image defect. Also it is possible to avoid a phenomenon of simultaneous release of the accumulated charge at a certain timing, thereby preventing a detrimental influence on the signal system of the main body resulting from such phenomenon.

Also in a configuration of grounding the metal film 102 through the fuse 116 as the excess current preventing element, even in case the heater 101 in sliding contact with the metal film 102 is broken for any reason and an AC current leaking from the heat-generating resistor b of the broken heater 101 to the metal film, the fuse 116 provided between the metal film 102 and the ground detects a current in excess of a predetermined value and interrupts the circuit, thereby preventing an accident that such current flows to the ground and is felt by the user. The present embodiment employs a fuse of a rating of 2 A(ampere). Therefore, the fuse is instantaneously cut off when the AC power supplied to the heater flows into the metal film. Also the fuse, employed as the excess current preventing element, facilitates a current flow from the metal film 102 to the ground in comparison with a case of employing a high resistance element, thus achieving a safety measure and a suppression of charging of the metal film 102 at the same time.

In the present embodiment, a conductive carbon tip 108*a* is employed as a contact portion of the conductive member 108 to the metal film 102, for achieving a conduction between the metal stay 103 and the metal film 102, but such configuration is not restrictive, and a similar effect is confirmed also for example by contacting an end of a conductive brush with the internal surface of the metal film 102.

Also in the present embodiment, the swing lateral plates 113*a*, 113*b* connected electrically with the metal stay 103 and used for pressurization are made of metal plates, but such configuration is not restrictive and a similar effect can be obtained for example with a conductive resin.

(Other Embodiments)

1) The heating member 10 is not limited to a ceramic heater as shown in the foregoing embodiment, but can also be formed by a nickel-chromium wire, an induction heat-generating member such as an iron piece, or a PTC heat-generating member. Also the heating member 101 need not necessarily be positioned at the nip N. The metal film 102 may be heated by arbitrary heating means from the internal or external side.
2) In the foregoing embodiment, the metal film 102 is formed as a cylindrical member which is rotated by driving by the pressure roller, but there can also be employed any arbitrary driving means such as a configuration in which a driving roller and a tension provided are inside an endless film and the driving roller is driven to rotate the endless film.
3) The pressurizing rotary member 105 is not limited to a roller member but may also be formed as a rotating endless belt.
4) The image heating apparatus of the present invention is usable not only as an image heat fixing apparatus as described in the embodiment but also applicable a temporarily fixing apparatus for temporarily fixing an unfixed image to a recording material, or a surface improving apparatus for reheating a recording material, bearing a fixed image, thereby improving a surface property such as luster of the image. It is naturally applicable also as an image heating apparatus for heating a heated member, such as a heat pressing apparatus for removing creases for example in a banknote, a heat laminating apparatus, a heat drying apparatus for evaporating moisture contained in paper or the like, an image heating apparatus for drying in an ink jet printer or the like.

The present invention is not limited to the aforementioned embodiments but includes any and all modifications within the technical concept of the invention.

This application claims priority from Japanese Patent Application No. 2003-400082 filed Nov. 28, 2003, which is hereby incorporated by reference herein.

What is claimed is:

1. An image heating apparatus comprising:

a rotation member made of a metal;

a heater to which a current is applied, whereby heat dissipates from the heater, said heater contacting an internal surface of the said rotation member;

a holder made of a resinous material, for holding said heater;

a pressure roller for forming a nip portion in cooperation with said heater, with said rotation member being interposed;

a stay made of a metal material for pressing said holder toward said pressure roller; and an elastic conductive member for electrically connecting the internal surface of said rotation member and said stay, said elastic conductive member having end portions, wherein one of the end portions of said elastic conductive member is fixed to said stay, and an other of the end portions of said elastic conductive member holds said contact member, and the contact member slides on the internal surface of said rotation member, and wherein said elastic conductive member deflects so that the other of the end portions of said elastic conductive member is placed on a downstream side of the one of the end portions of said elastic conductive member in a rotation direction, and said rotation member is electrically grounded via said stay and a fuse.

2. An image heating apparatus according to claim 1, wherein said rotation member includes an elastic layer on an external periphery of a metal layer.

3. An image heating apparatus according to claim 1, further comprising:

temperature detection means for detecting a temperature of said rotation member, wherein said temperature detection means comprises:

a base portion;

a temperature detection element; and a supporting member for supporting said temperature detection element, said supporting member having end portions, wherein one of the end portions of said supporting member is fixed to said base portion, an other of the end portions of said supporting member holds said temperature detection element, and said temperature detection element slides on the internal surface of said rotation member, and wherein a direction in which the other of the end portions of said supporting member deflects with regard to the one of the end portions of said supporting member is the same as a direction in which the other of the end portions of said elastic conductive member deflects with regard to the one of the end portions of said elastic conductive member.

* * * * *

UNITED STATES PATENT AND TRADEMARK OFFICE

CERTIFICATE OF CORRECTION

PATENT NO. : 7,209,696 B2
APPLICATION NO. : 10/995228
DATED : April 24, 2007
INVENTOR(S) : Umezawa et al.

It is certified that error appears in the above-identified patent and that said Letters Patent is hereby corrected as shown below:

ON THE TITLE PAGE
Item (56), Abstract, line 1, "made" should read --member made--.

COLUMN 2
Line 37, "induces" should read --induce--.

COLUMN 5
Line 20, "as" should read --a--.
Line 31, "am as wide" should read --as wide an--

COLUMN 8
Line 10, "also applicable" should read --is also applicable to--.

Signed and Sealed this

Third Day of June, 2008

JON W. DUDAS
*Director of the United States Patent and Trademark Office*